US006220344B1

(12) United States Patent
Beykirch et al.

(10) Patent No.: US 6,220,344 B1
(45) Date of Patent: Apr. 24, 2001

(54) TWO-PASSAGE HEAT-EXCHANGER TUBE

(75) Inventors: Helmut Beykirch, Menden; Stefan Geissler, Nordkirchen; Joachim Kautz, Balve, all of (DE)

(73) Assignee: HDE Metallwerk GmbH, Menden (DE)

( * ) Notice: Subject to any disclaimer, the term of this patent is extended or adjusted under 35 U.S.C. 154(b) by 0 days.

(21) Appl. No.: 09/518,450

(22) Filed: Mar. 3, 2000

(30) Foreign Application Priority Data

Mar. 3, 1999 (DE) ..... 199 09 368

(51) Int. Cl.[7] ..... F28D 7/12
(52) U.S. Cl. ..... 165/156; 165/154; 165/169
(58) Field of Search ..... 165/156, 154, 165/184, 140, 181, 169, 179

(56) References Cited

U.S. PATENT DOCUMENTS

| | | | | |
|---|---|---|---|---|
| 1,005,441 | | 10/1911 | Lovekin . | |
| 3,332,446 | | 7/1967 | Mann . | |
| 3,566,615 | | 3/1971 | Roeder . | |
| 3,777,343 | | 12/1973 | D'Onofrio . | |
| 4,086,959 | * | 5/1978 | Habdas | 165/156 X |
| 4,351,389 | | 9/1982 | Guarneschelli . | |
| 4,924,838 | * | 5/1990 | McCandless | 165/156 X |
| 5,148,861 | * | 9/1992 | Colvin et al. | 165/156 X |
| 5,690,167 | * | 11/1997 | Rieger | 165/184 X |
| 5,799,726 | * | 9/1998 | Frank | 165/156 |

FOREIGN PATENT DOCUMENTS

| | | |
|---|---|---|
| 670481 | 1/1966 | (BE) . |
| 203201 | 10/1908 | (DE) . |
| 455 44 | 10/1950 | (DE) . |
| 804 502 | 4/1951 | (DE) . |
| 3320956 | 12/1984 | (DE) . |
| 317 64 | 1/1985 | (DE) . |
| 295 00 063 U | 2/1996 | (DE) . |
| 1158943 | 6/1958 | (FR) . |
| 394643 | 9/1931 | (GB) . |

* cited by examiner

*Primary Examiner*—Christopher Atkinson
(74) *Attorney, Agent, or Firm*—Herbert Dubno; Andrew Wilford

(57) ABSTRACT

A heat-exchanger tube has an inner tube wall centered on an axis, formed with an outwardly projecting helical ridge having a helical outer surface, and forming an outwardly open helical groove delimited by the ridge and an outer tube wall centered on an axis, formed with an inwardly projecting helical ridge of the same hand as the inner-tube ridge, having a helical inner surface, and forming an inwardly open helical groove delimited by the outer-tube ridge. The inner tube is coaxially received in the outer tube with the grooves together forming a helical passage having a plurality of turns and the surfaces radially confronting and spaced from each other to form an axial passage for fluid communication between adjacent turns of the helical passage. A fluid is fed to one end of the helical passage and withdrawn from an opposite end with flow of the fluid helically along the helical passage and axially through the axial passage.

8 Claims, 6 Drawing Sheets

TWO-PASSAGE HEAT-EXCHANGER TUBE

FIELD OF THE INVENTION

The present invention relates to a two-passage heat-exchanger tube. More particularly this invention concerns such a tube forming at least two separate passages through which fluids at different temperatures can flow for heat exchange between them.

BACKGROUND OF THE INVENTION

A heat-exchanger tube forming a pair of passages one of which extends helically is used in many different applications as described in German patent application 45,544, German patents 31,764 of Hocking and 804,502 of Sommer as well as in U.S. Pat. No. 3,566,615 of Roeder and U.S. Pat. No. 3,777,343 of D'Onofrio. A standard such system has an inner tube wall formed with a radially outwardly projecting helical ridge and an outer tube wall formed with a radially inwardly projecting helical ridge. The two tube walls are assembled together so the two ridges fit in direct contact with each other and create a helical passage. An outer passage can be provided around the two joined walls by fitting them with play in an outer pipe, and an inner pipe can be run coaxially through the inner wall to form an inner chamber. One fluid is flowed through the helical passage and another in the same direction or countercurrent through the outer and/or inner passage.

Such a heat-exchanger tube is fairly hard to manufacture. The inner and outer tube walls must be made to very exacting tolerances so that when they are fitted together the outer surface of the outwardly projecting ridge snugly engages the inner surface of the inwardly projecting ridge. Even with very accurate construction, assembling the system is quite difficult. Furthermore after some use, adhesions on the tube walls often make it impossible to pull the inner and outer walls apart for cleaning.

OBJECTS OF THE INVENTION

It is therefore an object of the present invention to provide an improved heat-exchanger tube assembly.

Another object is the provision of such an improved heat-exchanger tube assembly which overcomes the above-given disadvantages, that is which is of simple construction and which is easy to assemble and disassemble.

SUMMARY OF THE INVENTION

A heat-exchanger tube has according to the invention an inner tube wall centered on an axis, formed with an outwardly projecting helical ridge having a helical outer surface, and forming an outwardly open helical groove delimited by the ridge and an outer tube wall centered on an axis, formed with an inwardly projecting helical ridge of the same hand as the inner-tube ridge, having a helical inner surface, and forming an inwardly open helical groove delimited by the outer-tube ridge. The inner tube is coaxially received in the outer tube with the grooves together forming a helical passage having a plurality of turns and the surfaces radially confronting and spaced from each other to form an axial passage for fluid communication between adjacent turns of the helical passage. A fluid is fed to one end of the helical passage and withdrawn from an opposite end with flow of the fluid helically along the helical passage and axially through the axial passage.

It has surprisingly been found that leaving a space between the inner-ridge outer surface and the outer-ridge inner surface does not appreciably affect the heat-exchange efficiency of the tube according to the invention. The bulk of the flow is still helical with the axial leakage having little effect on overall residence time of the fluid between the tube walls. On the other hand the spacing of the inner and outer ridge surfaces makes it much easier to manufacture the two tube walls, since if they are a tiny bit too big or small they will still fit together, and makes it very easy to assemble and disassemble the tube according to the invention.

The helical passage in accordance with the invention has a flow cross section that is substantially greater than a flow cross section of the axial passage. This is typically done by making the grooves axially longer (that is wider) than the ridges and making the helical passage substantially deeper measured radially than the space between the ridge surfaces. The grooves are of generally rectangular section and the surfaces extend parallel to the respective axes.

According to the invention an inner pipe spaced radially coaxially inside the inner wall therewith an inner passage, and an outer pipe spaced radially coaxially outside the outer wall forms therewith an outer passage. The inner and outer pipes can be cylindrical or helically corrugated.

Since with the system of this invention the loose fit makes it difficult to determine if the inner-tube ridge is radially aligned with the outer-tube ridge, the inner and outer tubes are formed with markings that are aligned axially when the inner-tube ridge is radially aligned with the outer-tube ridge. These markings can be bumps.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
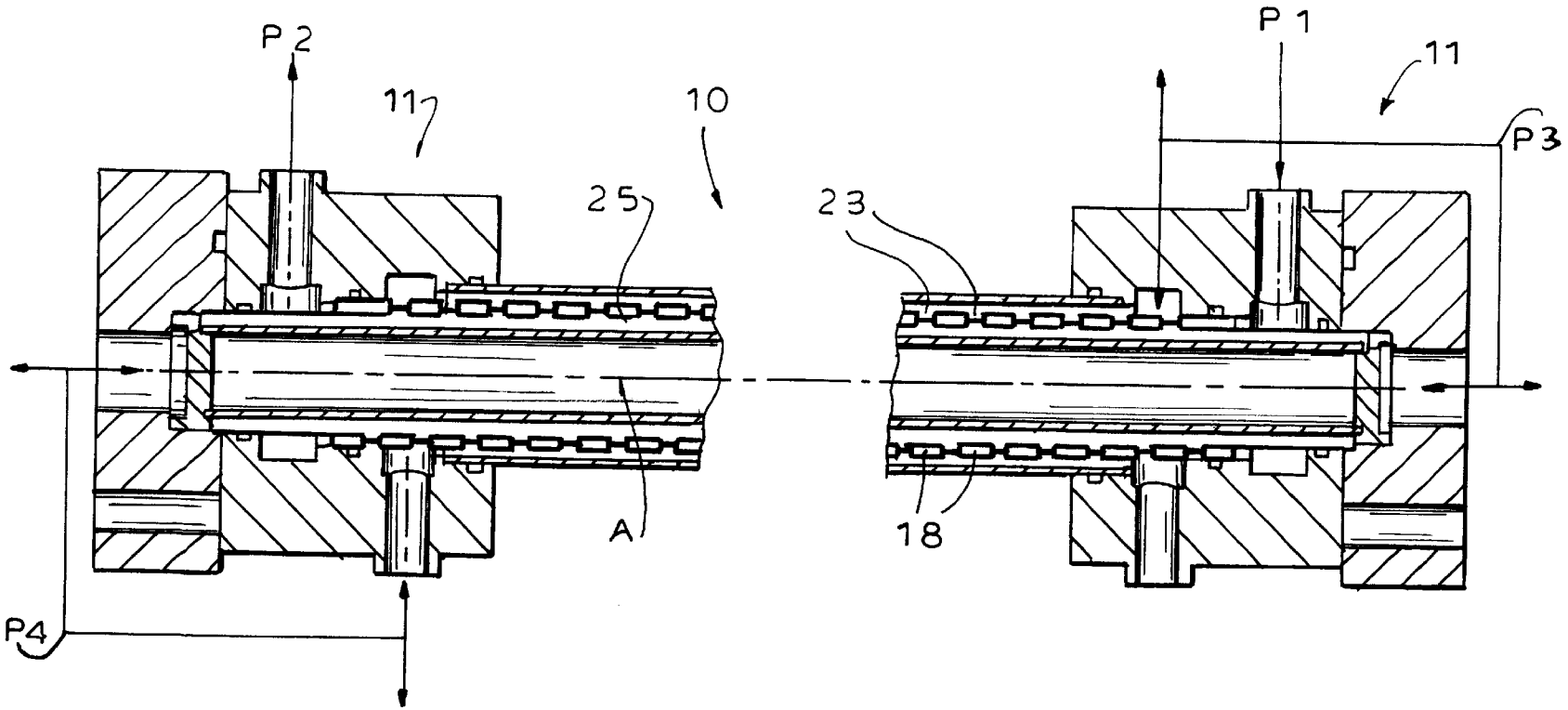
FIG. 1 is a small-scale axial section through a heat-exchanger assembly according to the invention.
Figure 2:
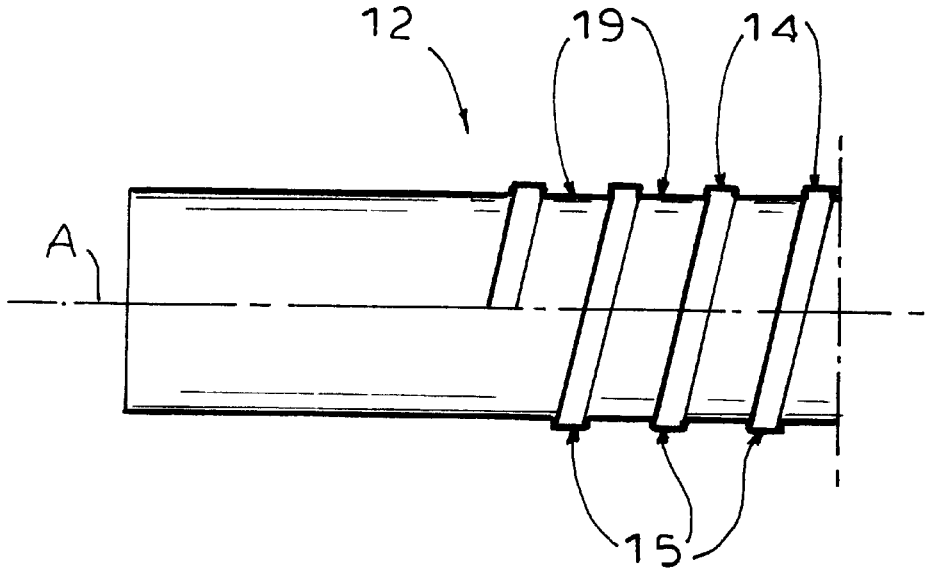
FIGS. 2 and 3 are axial sections through the inner and outer walls of the tube.
Figure 3:
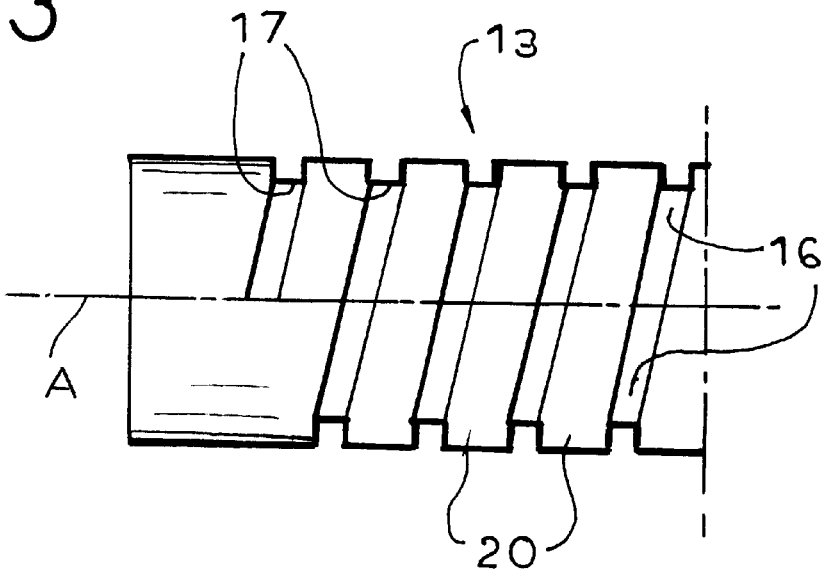
Figure 4:
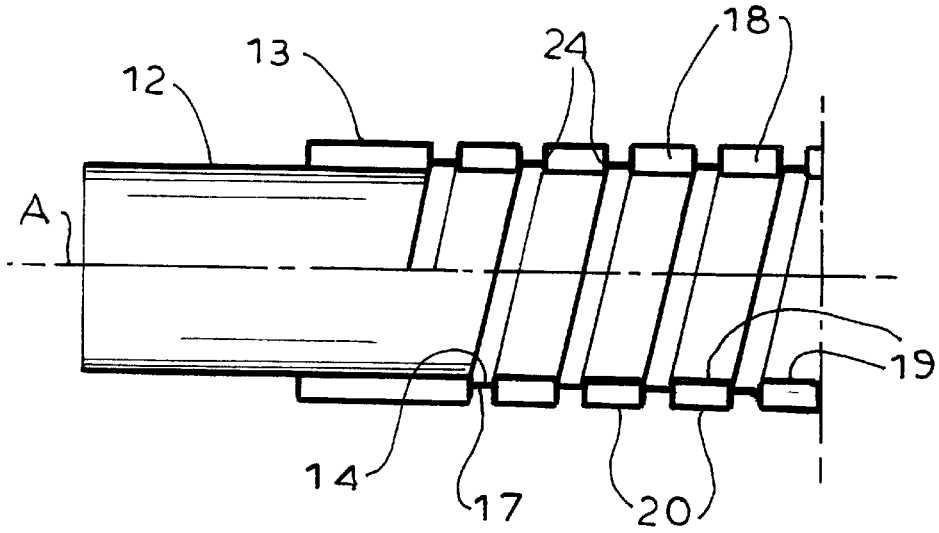
FIG. 4 is an axial section through the assembled tube.

As seen in FIG. 1 a heat-exchanger tube 10 extends between two manifold fittings 11. The tube 10 is centered on an axis A and forms as described below a helical passage 18 extending from an inlet P1 to an outlet P2 and a second passages 23 and 25 outside and inside the passage 18 and extending from an inlet P3 to an outlet P4, or vice versa from P4 to P3. Respective fluids in the passages 18 and 23 are at different temperatures and exchange heat through the walls between the passages 18, 23, and 25.

As shown in FIGS. 2 through 5, the tube 10 comprises a tubular inner wall 12 (FIG. 2) and a tubular outer wall 13 (FIG. 3) of uniform wall thickness and fitted coaxially together (FIG. 4) to form the passage 18. The inner tubular wall 12 has a radially outwardly projecting rectangular-section helical ridge 15 having an outer surface 14 and forming a rectangular-section helical outwardly open groove 19. The tubular outer wall 13 has a radially inwardly projecting rectangular-section helical ridge 16 having an inner surface 17 and forming a rectangular-section helical inwardly open groove 20. The ridges 15 and 16 are of the same axial dimension and pitch so the grooves 19 and 20 will also be of the same axial dimension and pitch.

Figure 7:
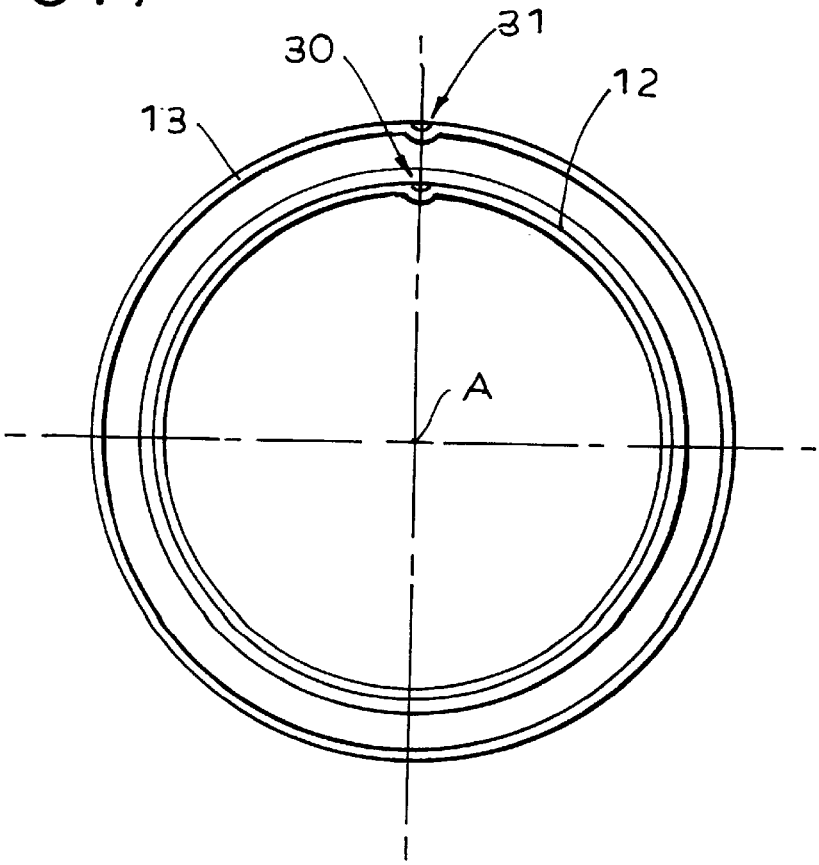
FIG. 7 is an end view taken in the direction of arrow VII of FIG. 6.

The two tubular walls 12 and 13 are assembled coaxially with the outer face 14 of the ridge 15 directly confronting but separated by an axial space or passage 24 (FIG. 5) from the inner face 17 of the ridge 16. Thus the total radial heights of the ridges 15 and 16 is less than the radial dimension of the passage 18. The inner wall 12 is formed with a marking 30 (see FIGS. 6 and 7) in the form of an inwardly directed circular dimple and the outer tube 13 is similarly formed with another such dimple 31 that are axially aligned when the tube wall 12 is properly inserted into the wall 13 with the ridges 15 and 16 aligned.

Thus the two grooves 19 and 20 combine to form the helical passage 18 which is of considerably greater radial and axial dimension than the space 24 between the faces 14 and 17. The flow from input P1 to output P2 will therefore primarily exist as a helically flowing stream along the helical passage 18 formed by the grooves 19 and 20. There will be some axial leakage through the space 24 between adjacent turns of the helical flow in the passage 18 that will serve to keep the space 24 clear without significantly impairing heat-exchange effect. In addition the space 24 makes fitting the two tube walls 12 and 13 together and taking them apart a relatively simple operation. Even minor accretions on the tube walls 12 and 13 will not prevent them from being separated for cleaning.

Figure 5:
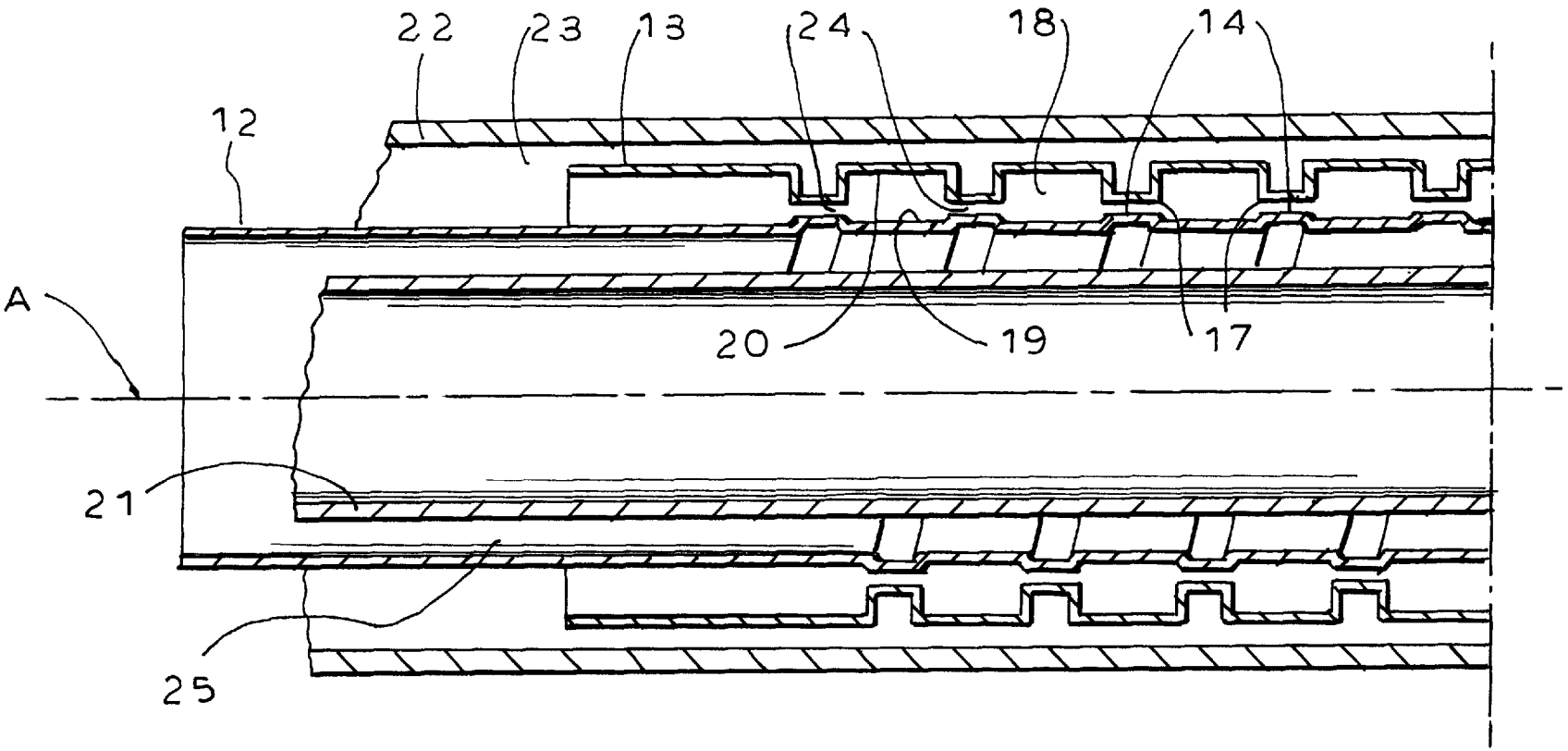
FIG. 5 is a larger-scale view of the tube according to the invention combined with inner and outer pipes.
Figure 6:
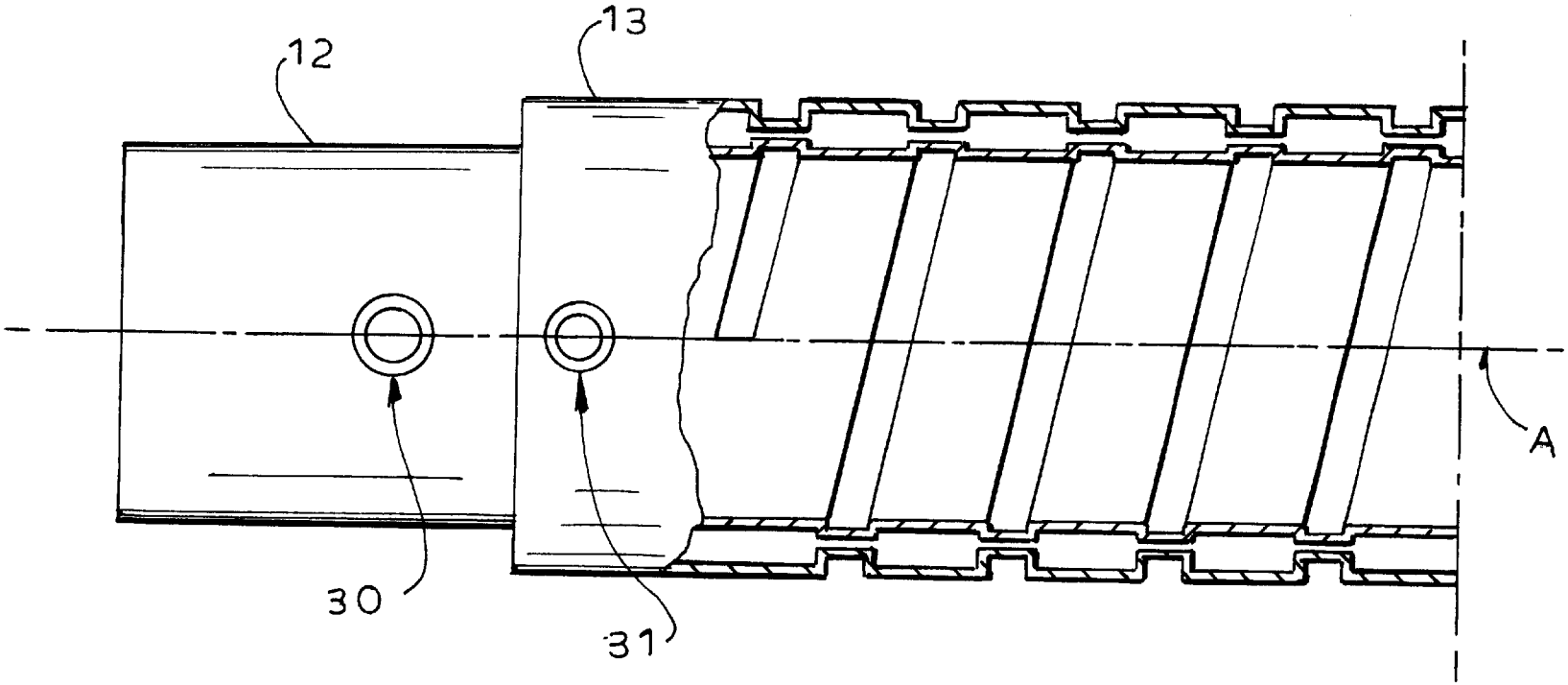
FIG. 6 is a partly axial section through an end of the tube in accordance with the invention.

The tube 10 further includes as shown in FIG. 5 an outer cylindrical pipe 22 spacedly surrounding the outer wall 13 and an inner cylindrical pipe 21 received with spacing inside the inner wall 12. The outer pipe 22 therefore forms the outer wall of the passage 23 and the inner pipe 21 the inner wall of the passage 25. Normally the passages 23 and 25 are connected together at their ends so the same fluid is flowed outside and inside the passage 18 formed by the walls 12 and 13.

Figure 8:
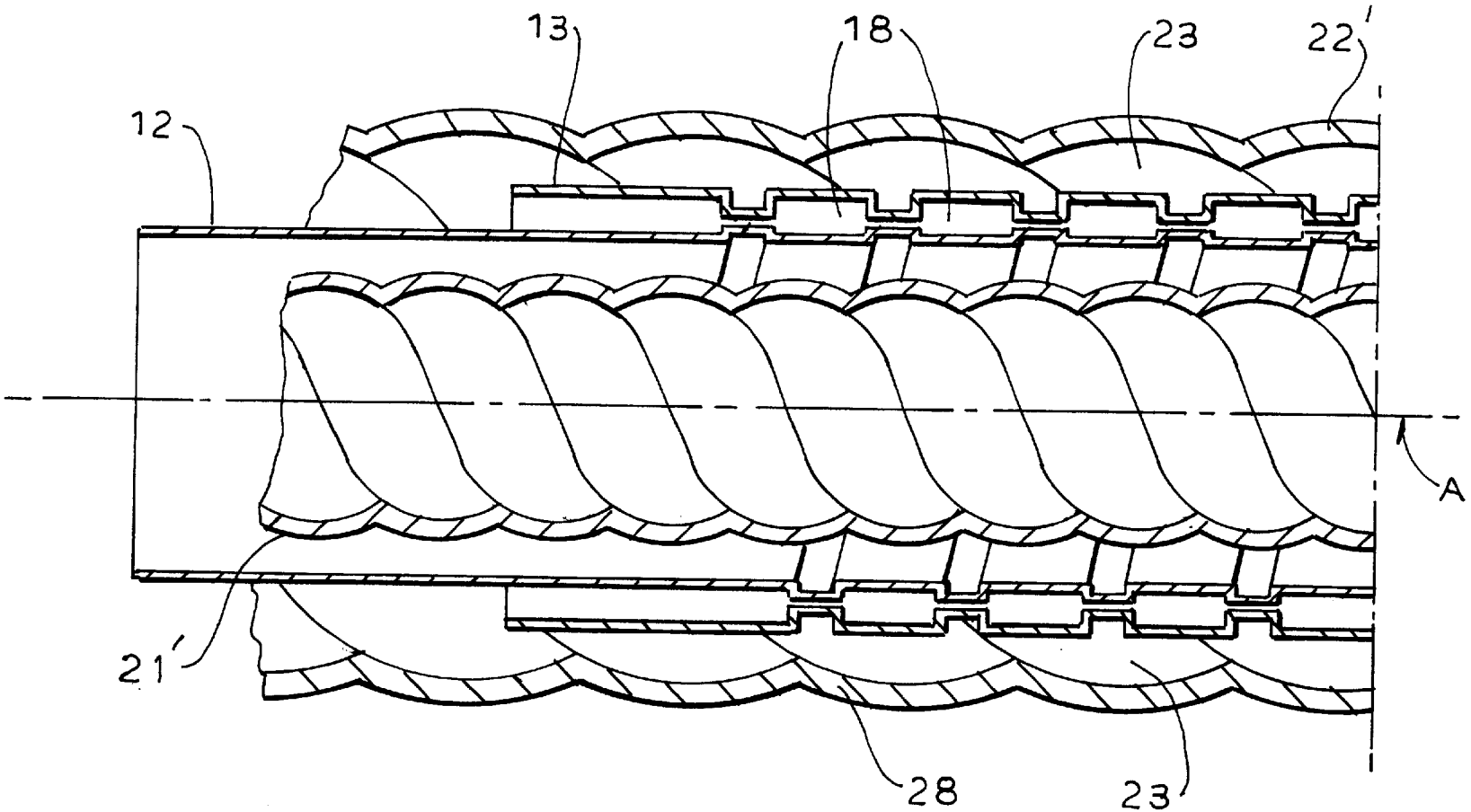
FIG. 8 is a view like FIG. 5 but showing an alternative tube assembly.

In the system of FIG. 8 helically corrugated inner and outer pipes 21' and 22' are used. The circularly arcuate corrugations make the flow in the outer and inner passage 23 and 25 substantially more turbulent for better heat-exchange effect.

We claim:

1. A heat-exchanger tube comprising:

an inner tube wall centered on an axis, formed with an outwardly projecting helical ridge of predetermined hand and having a helical outer surface, and forming an outwardly open helical groove delimited by the ridge;

an outer tube wall centered on an axis, formed with an inwardly projecting helical ridge of the same hand as the inner-tube ridge, having a helical inner surface, and forming an inwardly open helical groove delimited by the outer-tube ridge, the inner tube being coaxially received in the outer tube with the grooves together forming a helical passage having a plurality of turns and the surfaces radially confronting and spaced from each other to form an axial passage for fluid communication between adjacent turns of the helical passage; and means for feeding a fluid to one end of the helical passage and withdrawing the fluid from an opposite end with flow of the fluid helically along the helical passage and axially through the axial passage.

2. The heat-exchanger tube defined in claim 1 wherein the helical passage has a flow cross section that is substantially greater than a flow cross section of the axial passage.

3. The heat-exchanger tube defined in claim 1 wherein the grooves are of generally rectangular section and the surfaces extend parallel to the respective axes.

4. The heat-exchanger tube defined in claim 1, further comprising an inner pipe spaced radially coaxially inside the inner wall and forming therewith an inner passage; and an outer pipe spaced radially coaxially outside the outer wall and forming therewith an outer passage.

5. The heat-exchanger tube defined in claim 4 wherein the inner and outer pipes are cylindrical.

6. The heat-exchanger tube defined in claim 4 wherein the inner and outer pipes are helically corrugated.

7. The heat-exchanger tube defined in claim 1 wherein the inner and outer tubes are formed with markings that are aligned axially when the inner-tube ridge is radially aligned with the outer-tube ridge.

8. The heat-exchanger tube defined in claim 7 wherein the markings are bumps.

* * * * *